US011262139B2

(12) United States Patent
Schlieper et al.

(10) Patent No.: US 11,262,139 B2
(45) Date of Patent: Mar. 1, 2022

(54) HEAT EXCHANGER

(71) Applicant: Kelvion Machine Cooling Systems GmbH, Herne (DE)

(72) Inventors: Andreas Schlieper, Selm (DE); Frank Kornetzky, Herne (DE); Sentuerk Oruc, Herne (DE); Matthias Klein-Lassek, Velbert (DE); Dietmar Krauss, Hückeswagen (DE); Martin Lohbreyer, Dorsten (DE)

(73) Assignee: Kelvion Machine Cooling Systems GmbH, Herne (DE)

( * ) Notice: Subject to any disclaimer, the term of this patent is extended or adjusted under 35 U.S.C. 154(b) by 0 days.

(21) Appl. No.: 17/252,629

(22) PCT Filed: Jun. 19, 2019

(86) PCT No.: PCT/DE2019/100570

§ 371 (c)(1),
(2) Date: Dec. 15, 2020

(87) PCT Pub. No.: WO2020/015777

PCT Pub. Date: Jan. 23, 2020

(65) Prior Publication Data

US 2021/0270542 A1 Sep. 2, 2021

(30) Foreign Application Priority Data

Jul. 19, 2018 (DE) ..... 10 2018 117 457.8

(51) Int. Cl.
*F28D 21/00* (2006.01)
*F28F 1/32* (2006.01)

(52) U.S. Cl.
CPC ..... *F28D 21/0003* (2013.01); *F28F 1/325* (2013.01); *F28D 2021/0082* (2013.01); *F28F 2265/26* (2013.01)

(58) Field of Classification Search
CPC ..... F28F 1/325; F28F 1/24; F28F 1/32; F28F 1/128; F28F 2265/26; F28D 21/0003; F28D 2021/0082
See application file for complete search history.

(56) References Cited

U.S. PATENT DOCUMENTS 3,916,989 A * 11/1975 Harada ..... F28F 1/325 165/151
4,449,581 A 5/1984 Blystone et al.
(Continued)

FOREIGN PATENT DOCUMENTS

DE 1 000 407 1/1957
DE 102008011557 6/2009
(Continued)

OTHER PUBLICATIONS

International Search Report issued by the European Patent Office in International Application PCT/DE2019/100570 dated Sep. 17, 2019.

*Primary Examiner* — Tho V Duong
(74) *Attorney, Agent, or Firm* — Henry M. Feiereisen LLC

(57) ABSTRACT

A heat exchanger for cooling a gas includes a gas inlet, a gas outlet, and a plurality of cooling tubes arranged between the gas inlet and the gas outlet, wherein the cooling tubes of two successive tube rows are arranged offset transversely to a flow direction of the gas. A fin having openings is provided for receiving a corresponding number of the cooling tubes. The fin has slits arranged at a distance from the openings and configured to follow an edge profile of a honeycomb-shaped hexagon, with the slits of each hexagon surrounding a corresponding one of the openings at the distance. Arranged between adjacent ones of the openings is a corresponding one of the slits at a same distance from each of the adjacent openings, with each slit having an end ending at a deformation point of the fin.

16 Claims, 8 Drawing Sheets

(56) References Cited

U.S. PATENT DOCUMENTS

| | | | | | |
|---|---|---|---|---|---|
| 4,550,776 | A | * | 11/1985 | Lu | F28F 1/325 165/151 |
| 4,566,359 | A | * | 1/1986 | Miyagi | B21D 53/085 83/100 |
| 4,907,646 | A | | 3/1990 | Aoyagi et al. | |
| 5,168,923 | A | * | 12/1992 | Sacks | B21D 53/04 165/151 |
| 5,660,230 | A | * | 8/1997 | Obosu | F28F 1/325 165/151 |
| 5,685,367 | A | | 11/1997 | Jun | |
| 5,794,690 | A | * | 8/1998 | Kim | F28F 1/325 165/151 |
| 5,957,194 | A | | 9/1999 | Baek et al. | |
| 2011/0185714 | A1 | | 8/2011 | Lohbreyer et al. | |

FOREIGN PATENT DOCUMENTS

| | | | | | |
|---|---|---|---|---|---|
| DE | 102008011558 | | | 6/2009 | |
| DE | 102010038945 | | | 2/2012 | |
| DE | 102012217323 | | | 3/2014 | |
| EP | 0 044 734 | | | 1/1982 | |
| FR | 467 820 | | | 6/1914 | |
| JP | 59137793 | U | * | 9/1984 | |
| JP | H05-045475 | U | | 6/1993 | |
| JP | 09049641 | A | * | 2/1997 | F28F 1/325 |
| JP | 2000-230795 | A | | 8/2000 | |
| JP | 2006-349340 | A | | 12/2006 | |
| JP | 5193310 | B2 | | 5/2013 | |

* cited by examiner

HEAT EXCHANGER

CROSS-REFERENCES TO RELATED APPLICATIONS

This application is the U.S. National Stage of International Application No, PCT/DE2019/100570, filed Jun. 19, 2019, which designated the United States and has been published as International Publication No. WO 2020/015777 A1 and which claims the priority of German Patent Application, Serial No. 10 2018 117 457.8, filed Jul. 19, 2018, pursuant to 35 U.S.C. 119(a)-(d).

BACKGROUND OF THE INVENTION

The invention relates to a heat exchanger.

Heat exchangers for cooling gases are used as hot gas coolers, e.g. in the form of exhaust gas recirculation coolers or charge air coolers. Hot gas coolers allow mixing of recirculating exhaust gases with combustion gases at the lowest possible temperature for medium- or low-speed engines. Hot gas coolers are therefore a decisive element in the exhaust gas recirculation systems in enabling the applicable emissions directives to be met. In high-pressure exhaust gas systems, exhaust gases can be cooled from over 700° C. to 50° C. The thermal loading of such hot gas coolers is very high. High thermal stresses arise in the components of the exhaust gas flow.

DE 10 2008 011 558 B4 discloses a heat exchanger with cooling fins which have turbulators stamped in the form of troughs. The turbulators improve heat exchange and enhance the effectiveness of the heat exchanger. By means of cooling fins, it is possible to provide a heat exchanger area on the gas side which is larger by a factor of about 8 to 20 than on the coolant side. In the case of hot gas coolers, it should be noted that, in some cases of operation, the gas flow often enters the heat exchanger at very high speed and in a point-oriented manner. In some cases, this leads to insufficient homogeneity factors, with values <0.95, in the individual stages following one another in the flow direction of the gas. These very high point loads lead as it were locally to very high thermal stresses. Fin arrangements in which the stiffness is too high can lead to fatigue fractures in the cooling tubes, especially at the transition to the tube sheet. In DE 10 2012 217 323 A1, the proposal was therefore made for a fin to have an expansion bead for stress compensation and, in addition, for the material thickness to be reduced or a slit for stress compensation to be introduced in the region of the expansion bead. The production of expansion beads in combination with the reduction of the material thickness or the additional introduction of slits in the region of the expansion bead is technically relatively complex.

Taking this as a starting point, it is the underlying object of the invention to specify a heat exchanger which exhibits lower stress loads in the cooling tubes, even at very high temperature gradients, and in which consequently the creep strength is improved.

SUMMARY OF THE INVENTION

This object is achieved by a heat exchanger as set forth hereinafter.

The dependent claims relate to advantageous developments of the invention.

The heat exchanger according to the invention for cooling hot gases is, in particular, an exhaust gas recirculation cooler or, alternatively, a charge air cooler. It has a gas inlet and, at a distance from the gas inlet, a gas outlet.

A plurality of cooling tubes is arranged between the gas inlet and the gas outlet. They extend transversely to the flow direction of the gas, The cooling medium is, in particular, water.

The cooling tubes are surrounded by fins. The fins may also be referred to as lamellae. According to the invention, it is envisaged that a fin of this kind has a plurality of openings, a plurality of cooling tubes thus being passed simultaneously through one fin or lamella. This is therefore not a question of individual ribbing of the individual cooling tubes, but a question of an assembly. An assembly of this kind preferably extends over virtually the entire inflow cross section of the heat exchanger.

In the invention, these fins have slits. These slits serve to compensate thermal stresses and to make the gas flow more uniform. The gas flow flows through the slits. The slits are at a distance from the openings in which the cooling tubes are located. In the invention, a special arrangement of the slits is employed: the slits are arranged in a honeycomb shape. That is to say that a plurality of slits surrounds each opening or each cooling tube in a hexagonal arrangement. One hexagon surrounds each opening. The slits follow the edge profile of the hexagon, and therefore the slits are preferably straight. The invention does not exclude a slit profile that is not straight as long as the arrangement remains hexagonal overall and is not circular, for example. The ends of slits at a corner of the hexagon are therefore at an angle to one another. In particular, the hexagon is equilateral and equiangular, as in the case of a regular hexagon.

Each slit ends at a deformation point of the fin. This deformation point is located at the corner of the hexagon. This deformation point is a special feature in comparison with constructions in which there are passages in the fins. The deformation region has the positive effect that the stiffness of the fin is reduced and allows plastic deformation in the case of high (thermal) loads. Creating a deformation point within the fin makes it possible for the flexible point to be plastically deformed in the case of necessity, i.e. when there is a high point load. However, this does not lead to continuous deformations within the entire fin, nor to functional impairments of other parts of the heat exchanger. This reduction in stiffness ensures lower thermally induced stresses in the cooling tubes. Studies have shown that instances of plastification at the transition from the cooling tube to a tube sheet in which the cooling tube is secured can be reduced by up to 80%. As a result, a higher creep strength for the entire heat exchanger can be obtained, this being a direct consequence of the reduced stiffness of the fins or lamellae.

In an advantageous development of the invention, a width of the slits is greater than the minimum width of the deformation point. The deformation points should therefore be relatively narrow. The width of the slits depends on the desired mixing of the gas flow above and below the sits. It is not envisaged that the slits be arranged in the region of a bead of the fins. In a first preferred embodiment, the fin itself is substantially flat, apart from collars or rim holes for resting the cooling tubes against the fin. The slits the lead to an effect on the flow and to minimization of stresses induced by thermal expansion on the openings and tubes. In this context, "flat" means that the fin is not corrugated or grooved.

In a development of the invention, a fin can have individual embossed features. The slits are preferably arranged outside the embossed features, individual embossed features can improve the guidance of the flow. Slits outside the embossed features are easier to manufacture. The slits are not covered by projections of the fin of the kind which are formed when the stamped out pail for producing the slit is secured on one side of the slit or at at least one end of the slit.

The aim is that the fins should have a very high elongation at break. In particular, it should be above 25%.

It is advantageous if only a single slit is arranged between two adjacent openings. This slit is at the same distance from each of the adjacent openings. The invention also includes the single slit having constrictions, narrow points or interruptions between two adjacent openings, with the result that a plurality of shorter slits that follow one another in the longitudinal direction thereof together form functionally the single longer slit extending between two adjacent openings. It is not the number of slits which is critical but the honeycomb arrangement along the edge profile of a hexagon.

The cooling tubes of two successive tube rows are arranged offset transversely to the flow direction of the gas. If all the slits are of the same length, a uniform hexagonal or honeycomb pattern that repeats itself within a fin is obtained.

The opening for the cooling tube is the center of such a hexagon or such a honeycomb. The deformation point is the center of a star-shaped arrangement of three slits. In this sense, the deformation point is also star-shaped.

To reduce stresses caused by a notch effect, the slits are preferably rounded, in particular fully rounded, at the ends. The diameter of the rounding preferably corresponds to the width of the slits. Three slits, which are preferably arranged offset relative to one another by 120° in each case in the honeycomb shape, delimit a star-shaped deformation point. The ends of the three slits adjoin a common circle. It is simultaneously the incircle of the star-shaped deformation point. The diameter of this incircle is preferably approximately the same as the diameter of the end roundings of the slits. Owing to the mutual offsetting of the slits by 120° in the preferred honeycomb shape, however, the smallest distance between adjacent slits is somewhat less than said diameter. In this configuration, therefore, the width of the slits is greater than the width of the deformation point.

Within the scope of the invention, it is possible to select an even smaller deformation point or to make the slits longer. The slits are not so long that the deformation point is eliminated. In the case of slits of equal length, each slit in the preferred honeycomb shape extends over an angle of about less than 60° relative to the adjacent opening. In the case of the preferred honeycomb shape, there are no hexagonal individual fins but fins through which in all cases a plurality of cooling tubes are simultaneously passed.

The term "hexagon" or "honeycomb shape" in the context of the patent application should not be understood to mean that all sides of the hexagon must be of equal length or at the same angle to one another. Within the scope of the invention, it is possible that the mutually opposite slits are of equal length, wherein one pair of the opposite slits has a different length from the two other pairs of opposites slits. Such an arrangement of hexagons, which are as it were elongated, can be obtained if the distance of the tube rows is not equal to the distance between the tubes within a row. In this case, the slits that point from tube row to tube row are longer than the other pairs of slits. If the tube rows are at a shorter distance from one another than the distance between the tubes within a row, the slits that point from tube row to tube row are somewhat shorter than the other two pairs of slits.

In a development of the invention, a plurality of groups of cooling tubes is arranged between the gas inlet and the gas outlet of the heat exchanger. At least one first group of cooling tubes adjacent to the gas inlet is penetrated by said fins. A second and third group of said cooling tubes is preferably also penetrated. The formation of groups allows adaptation of the design of the individual groups to the locally prevailing thermal conditions. The groups are arranged at short distances from one another. In the case of three successive groups or stages, for example, there are therefore also three fins arranged in succession and at a distance from one another. In particular, all the groups of cooling tubes are provided with the said fins.

According to the invention, an individual group of cooling tubes comprises at least two tube rows, which are in series in the flow direction of the gas. The tube rows are arranged offset relative to one another, ensuring that an inflow area of the tubes is as large as possible.

In a development of the invention, the fins have edge sides lying in the flow direction of the gas, wherein at least one edge side has a sawtooth profile (about ±30° to the inflow area of the preferred honeycomb shape). The profiled shape can correspond to the pattern of the slits. The said fins can be produced from relatively large sheet-metal blanks. They are separated at the edge sides of the fins. The separating process can take place in the region of the deformation points, thus ensuring that very little material has to be cut for separation. The effort for separation of the fins into smaller units is very small.

In addition, a recess for the formation of a deformation point can be provided at the edge sides. This deformation point is intended to interact with the respective slit that is adjacent to the at least one edge side. These are the slits which point in the flow direction. The recess reduces the area of extent of the deformation point. The greatest point loads occur in the inflow region of the heat exchanger. Here, particularly low bending stiffness levels are advantageous. Consequently, the recesses should admittedly remain intact and at the same time also should simplify assembly. Nevertheless, they have the function of being plastically deformed in the case of necessity without having a negative effect on other regions of the fin or of the cooling tube.

In another embodiment of the invention, it is possible as it were to round or smooth the sawtooth shaped edge sides, ensuring that there are no particularly sharp or pointedly projecting corners on the edge sides. In another embodiment of the invention, it is possible for the slits, particularly on the edge side facing the flow, to extend as far as the edge side, with the result that there are no deformation points at all at the edge. In this case, the slits leading toward the edge side are open. The slits can even be widened somewhat further at their mouth. These widened portions can be produced by removing the originally present deformation points, e.g. by stamping. Here, the size selected for the region stamped out can be somewhat greater than the region of the deformation point, with the result that there are no constrictions at the transition from the edge side to the width of the slit. The stamped out areas are therefore preferably larger in width or diameter than the width of the slit.

If plastic deformations occur in a deformation point with the arrangement according to the invention of cooling tubes and fins, it is nevertheless impossible for a fin of this kind to move in the longitudinal direction of the cooling tube. The fins are preferably held in a stacked arrangement and fully surround the cooling tube. For this purpose, a collar arranged on the fins serves as a spacer. The height of the collar determines the spacing between adjacent fins. The collar surrounds the openings.

Apart from the collars which extend transversely to the plane of the fins and surround the cooling tubes, the fins are substantially flat. The high number of slits and openings, and the small deformation points, lead to fins of this kind being relatively light, but at least lighter than fins on which turbulators are extended in the same direction or alternately. Ultimately, the weight saving has a positive effect on the overall weight of the heat exchanger. Said fins have a thickness of a few tenths of a millimeter. The fins preferably have a thickness of less than 0.16 mm. The thickness is preferably 0.10 mm to 0.15 mm. Owing to the relatively low thickness, the term "lamellae" is also used in the case of such fins. The diameters of the openings and hence of the cooling tubes are preferably in a range of from 6 mm to 10 mm. The openings preferably have a diameter of from 7 to 8 mm. The spacing between adjacent tubes is approximately twice the diameter of the cooling tubes or the diameter of the opening. The width of the slits is about 15% to 25% of the diameter of the openings. However, the high proportion of openings and apertures does not have a negative effect on the effectiveness of heat transfer. In particular, a heat exchanger with a high creep strength is provided by said configuration of the fins.

BRIEF DESCRIPTION OF THE DRAWING

The invention is explained below by means of an illustrative embodiment, which is illustrated schematically in the drawings. In the drawings.

DETAILED DESCRIPTION OF PREFERRED EMBODIMENTS

Figure 1:
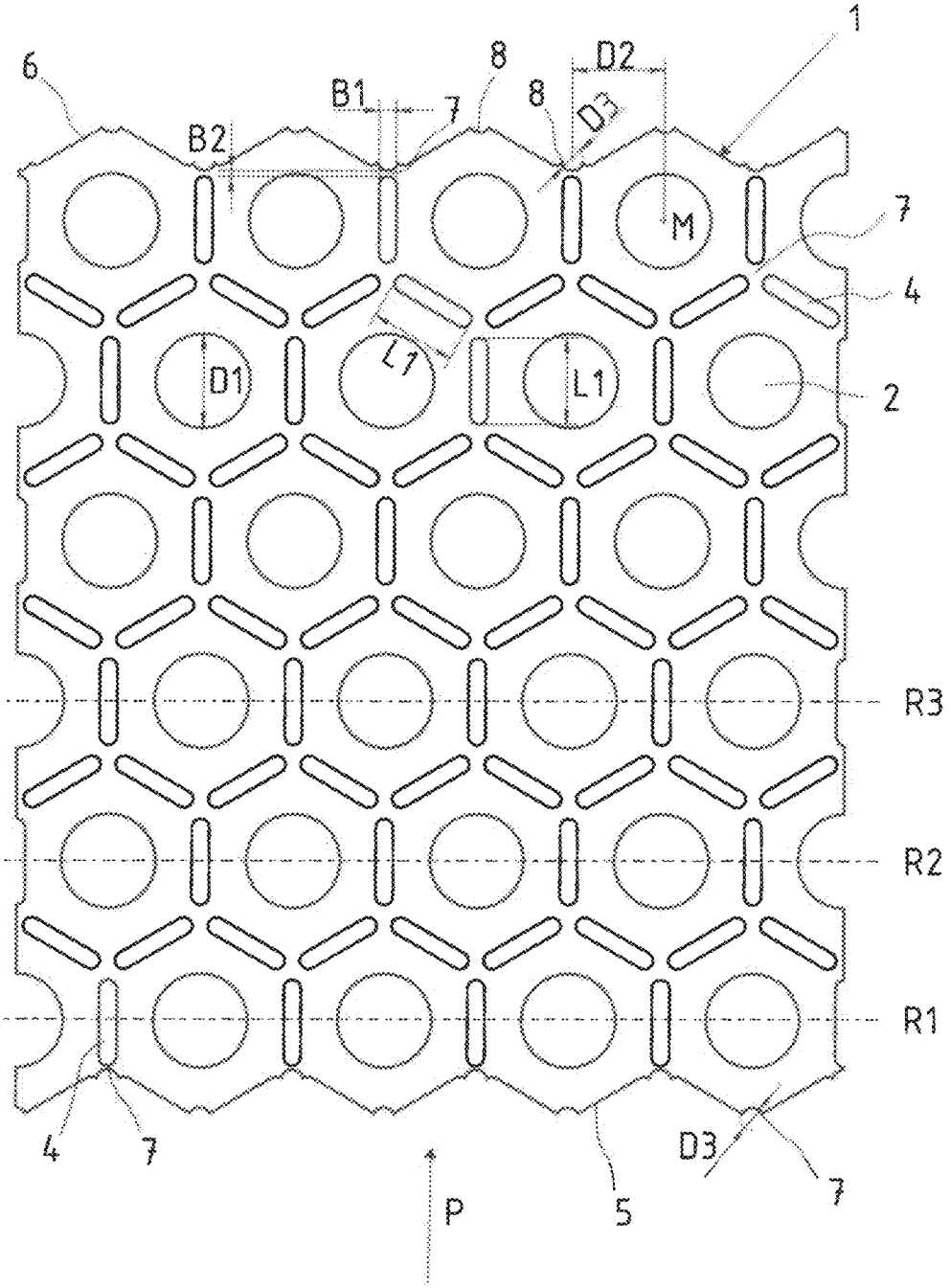
FIG. 1 shows a fin of a heat exchanger in plan view.
Figure 2:
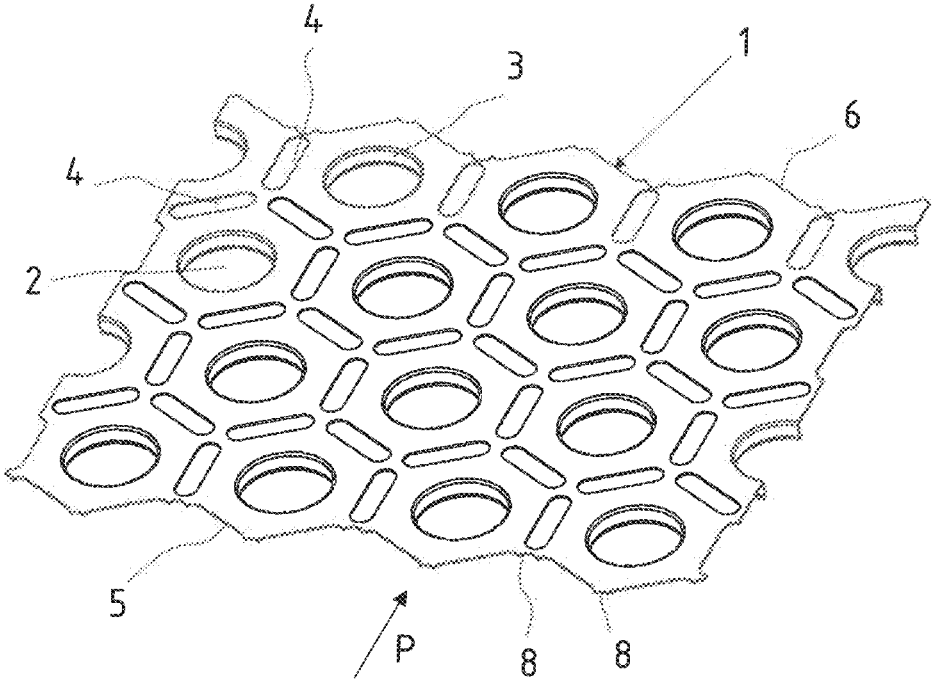
FIG. 2 shows the fin of FIG. 1 in perspective illustration.
Figure 4:
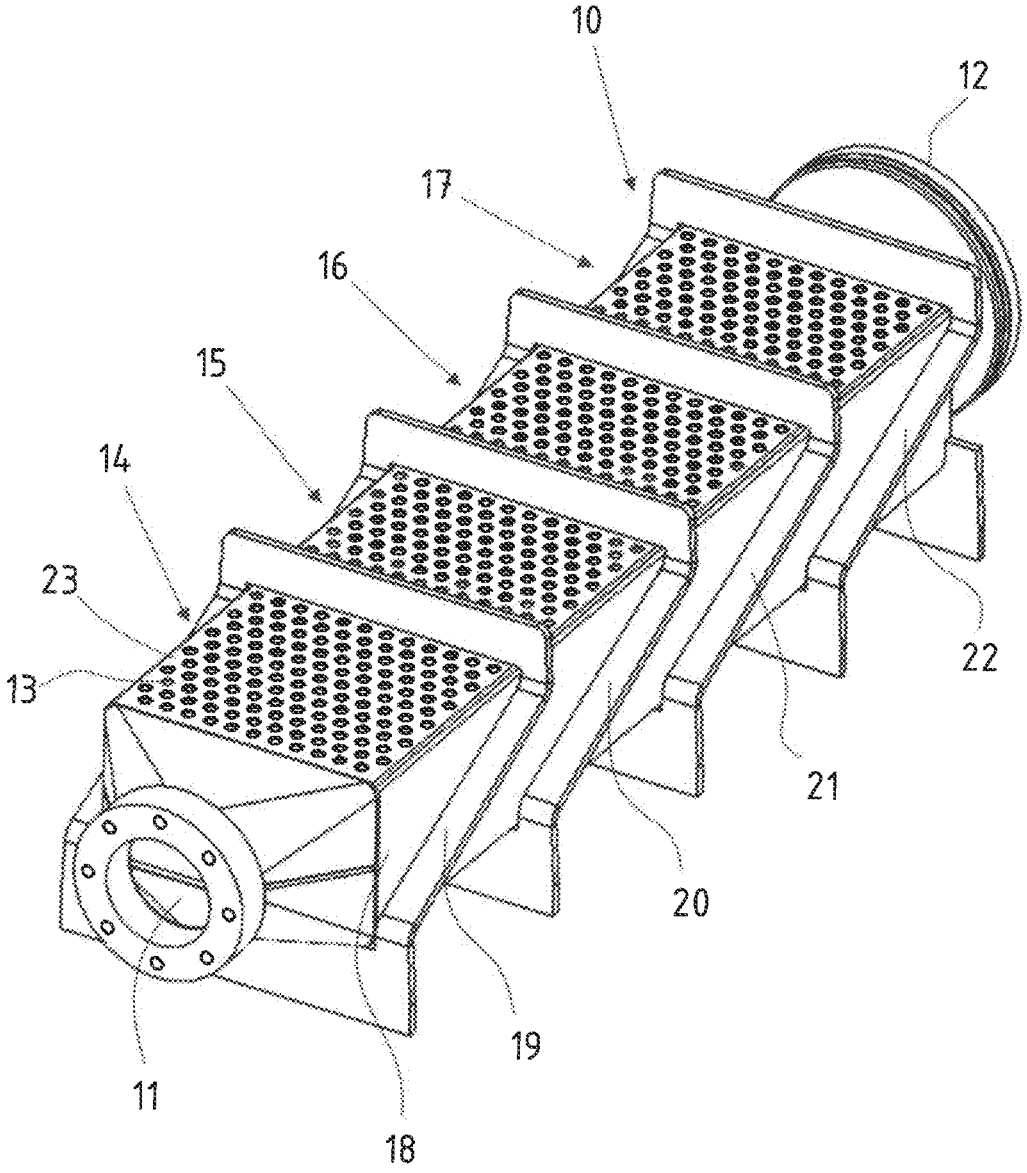
FIG. 4 shows a perspective illustration of a heat exchanger insert for cooling hot gases.
Figure 5:
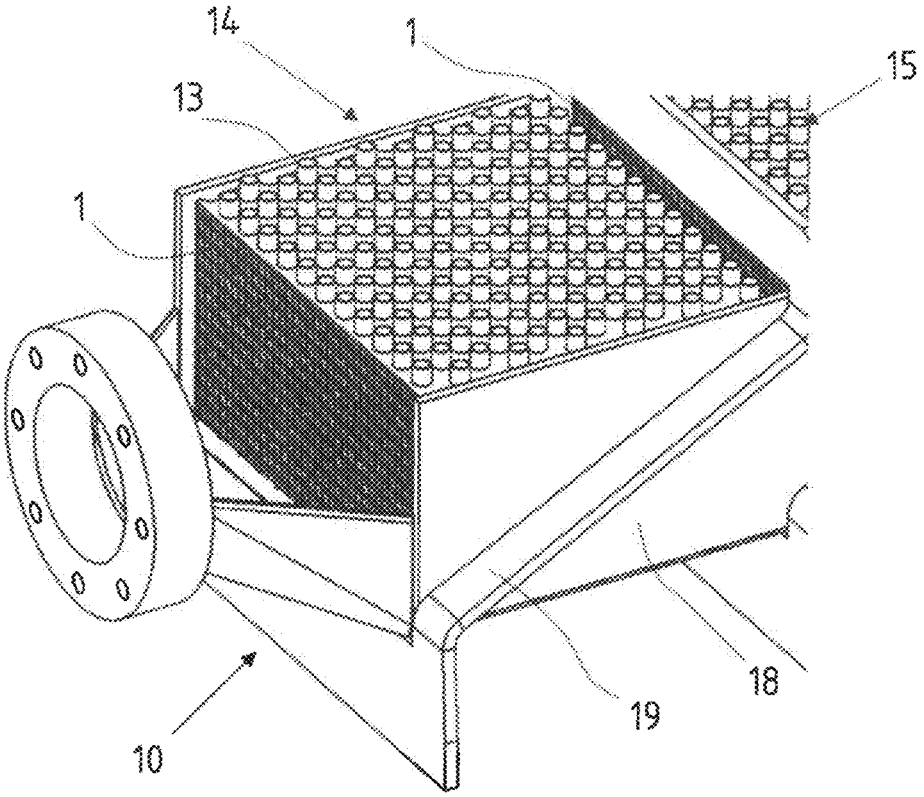
FIG. 5 shows the heat exchanger insert of FIG. 4 partially in section.
Figure 6:
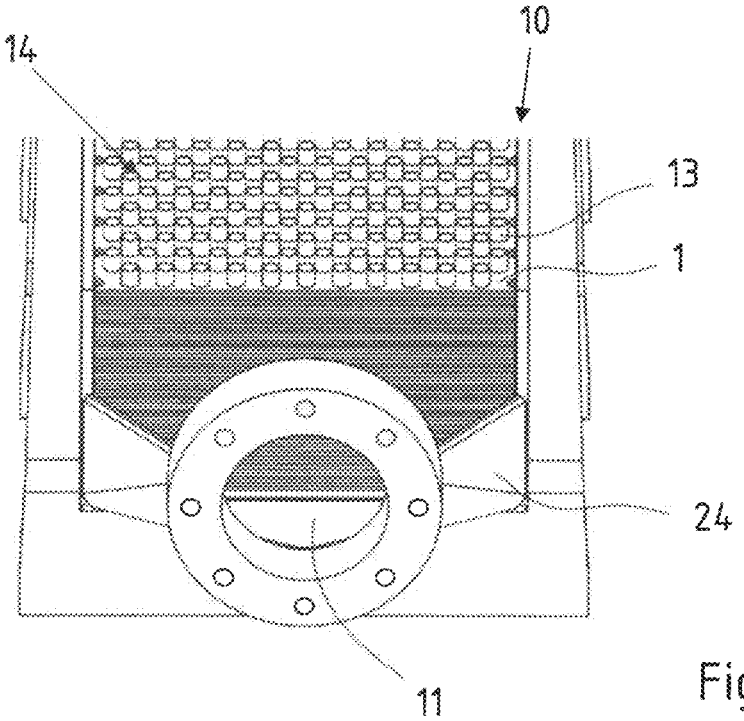
FIG. 6 shows the heat exchanger insert of FIG. 4 partially in section in another perspective view viewed in the direction of the hot gas inlet.

FIG. 1 shows a fin 1 of a heat exchanger, not illustrated specifically, for cooling gases. FIG. 2 shows said fin 1 in a perspective illustration. A plurality of cooling tubes penetrates said fins 1 in a manner not illustrated specifically. The fins 1 are mounted in a stacked arrangement (FIG. 6). Circular openings 2 in the fins 1 accommodate the cooling tubes 13 (FIG. 5). The openings 2 each have a collar 3, which faces downward in the plane of the image in FIG. 2. The collar 3 simultaneously determines the spacing between two successive stacked fins 1. A plurality of such fins 1 or lamellae arranged one above the other, with the cooling tubes 13 arranged therein, forms a group 14-17 (FIG. 4). An individual group 14-17 can also be referred to as a heat exchanger assembly. In the installed situation within the heat exchanger 10, an assembly of this kind is referred to as the first stage, second stage etc., depending on its position in the flow path. The individual assemblies or groups 14-17 can be arranged spaced apart. According to the invention, it is envisaged that at least one of these groups 14-17 of cooling tubes 13, in combination with said fins 1, is arranged within the heat exchanger 10 according to the invention, In particular, it is the group 14 which is closest to the gas inlet 11 (FIG. 4).

The perspective illustration in FIG. 2 shows that, apart from the collars 3, said fin 1 is flat. This is a fin 1 which is produced from a sheet-metal blank. Owing to use in heat exchangers 10 in an aggressive environment, the fins 1 are made of stainless steel. The steel preferably has a high elasticity with a uniform thickness, It is preferably 0.12 mm. One suitable material is X2CrTi12 with the material number 1.4512. This material has a tensile strength Rm of 380 to 560 $N/mm^2$. The proof stress Rp02 is about 280 to 290 N/mm. In practice, the elongation A 80% reaches values over 25%. In particular, the elongation is 30% and, in particular, is over 34%. Other conventional materials are the materials 1.4404 (austenitic high-grade steel) or 1.4521 (ferritic high-grade steel).

The special feature of the structure according to the invention of the heat exchanger 10 is the geometry of the fins 1. Next to the openings 2 for the cooling tubes 13, the fins 1 have regularly arranged slits 4. The slits 4 have the shape of elongate holes with fully rounded ends. All the slits 4 are straight, of the same length and of uniform width. They are arranged in a polygonal shape, more specifically in this case in a hexagon shape or honeycomb shape. The polygon shape described is a regular hexagon. There is one slit 4 between every two adjacent cooling tubes 13 or openings 2. The cooling tubes 13 or openings 2 are arranged in series in rows R1, R2, R3. The rows R1, R2, R3 etc. are each arranged offset transversely to the preceding row. As a result, there is an opening 2 or cooling tube 13 in each cell bounded by the six straight slits 4. The slits 4 have a length L1 The length L1 is slightly less than the diameter D1 of the circular opening 2. In this illustrative embodiment, the length L1 is 7.5 mm in comparison with the diameter D1 of 8 mm. The width B1 of the slits 4 is 1.5 mm. The ratio of the length L1 to the width B1 of the slits 4 is therefore 5:1. All the adjacent slits are at an angle W of 120° to one another.

The distance between the central longitudinal axis MLA of a slit 4 from a central point M of an opening 2 is denoted by D2 in FIG. 1. This distance D2 corresponds to the diameter D1 of the openings 2. A slit 4 is always located precisely in the center between two of the openings 2. All the openings 2 are located centrally in the individual cells formed by the slits 4. FIG. 1 furthermore shows that edge sides 5, 6 lying in the flow direction (arrow P) of the gas have a sawtooth profile. To produce the fins 1 a relatively large sheet metal blank was divided up, more specifically in the region of deformation points 7. These deformation points 7 are always bounded by a slit 4 facing in the flow direction P. Apart from the edge skies 5, 6, the deformation points 7 are located where in each case the ends of three slits 4 offset by 120° relative to one another are adjacent. The deformation points 7 are located at vertices of the polygon. In respect of the edge sides 5, 6, these are merely the slits 4 extending parallel to the flow direction P. Since these deformation points 7 at the edges are subject to particularly high thermal loads, it is envisaged that the deformation points created here are not more resistant than those that are arranged between the slits 4 arranged in a star shape.

There are therefore circular-arc-shaped recesses 8 of diameter D3 at the ends of the slits 4 which face the edge sides 5, 6. The recess 8 can be produced very easily by using a stamping tool that removes the actual core region of the deformation point 7.

Figure 3:
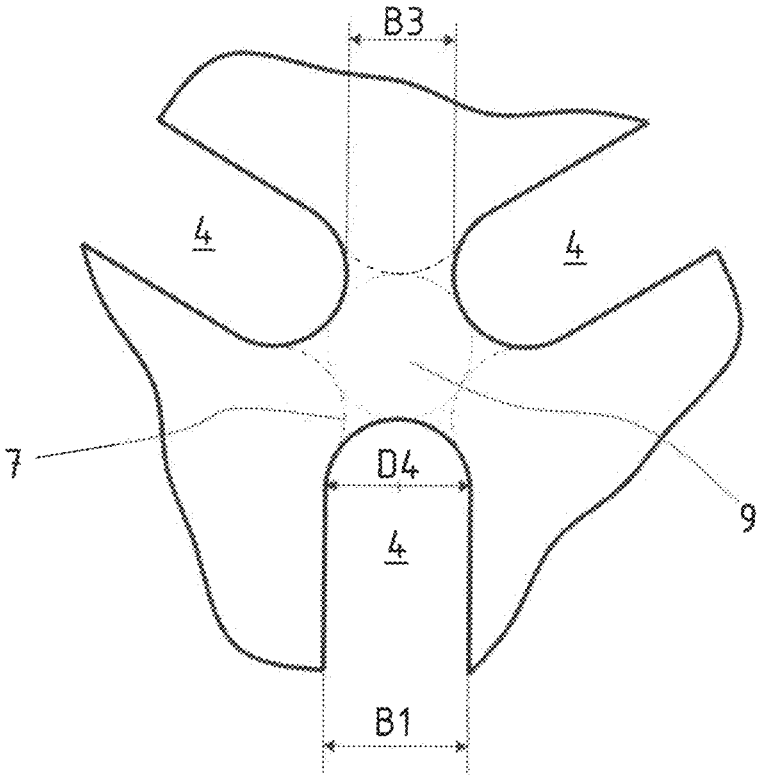
FIG. 3 shows a predetermined breaking region between three slits in an enlarged illustration.

FIG. 3 shows the deformation point 7 in an enlarged illustration. The boundaries of the deformation point 7 are indicated by the dashed line. The lines delimit the region in which the highest material stresses occur. From a design point of view, the three slits 4 delimit between them an incircle 9 enclosed by the star-shaped region of the deformation point 7. If the incircle 9 is removed by a stamping tool that is moved slightly upward in the plane of the image in FIG. 3, the stamping tool engages in the two upper slits 4. The stamping tool for removing the deformation point 7 and hence for separating the sheets preferably has a somewhat larger diameter. In this example, the width 81 of the slits 4 is equal to the diameter D4 of the rounded ends of the slits 4. The central region 9 also has this diameter D4. This is 1.5 mm, for example. In the case of a somewhat larger stamping tool with a diameter of 2 mm, for example, the recess 8 with the diameter D3 is obtained, which is then likewise 2 mm. To ensure that the fin 1 still has a deformation point 7 in the region of the recess 8, the recess 8 is positioned in such a way that a width B2 (FIG. 1) remains. In this illustrative embodiment, B2 is about one third of the width of the slit 4, i.e. about 0.5 mm.

In principle, the deformation point 7 is narrower at its narrowest point B3 (FIG. 3) than the width B1 of the slits 4.

Variations within the scope of the invention are possible by modifying the length L1 of the individual slits 4. Longer slits 4 result in smaller deformation points 7 and increase the elasticity of the fin 1. Shorter slits 4 would increase the stiffness of the fin 1.

FIG. 4 shows a heat exchanger 1 for cooling hot gases. The illustrated heat exchanger has a gas inlet 11 and a gas outlet 12 at a distance from the gas inlet 11. A multiplicity of parallel cooling tubes 13 is arranged between the gas inlet 11 and the gas outlet 12. The cooling tubes 13 are surrounded by the fins 1 as explained above.

FIG. 4 shows that the heat exchanger 10 has a plurality of groups 14-17 arranged in series. The hot gas to be cooled flows successively through the groups 14-17. The cooling water which flows through the cooling tubes 13 is deflected between two successive groups 14-17. For this purpose, there are baffles 19-22 outside a housing 18 surrounding the cooling tubes 13 and the fins 1. The heat exchanger 10 illustrated is inserted into another housing (not illustrated specifically). Cooling water is fed to the first group 14 from above in the plane of the image, for example. The cooling water then flows through the cooling tubes 13 from the top down and emerges underneath the first group 14. Between the two baffles 19, 20, the cooling water flows around the first group 14 and the subsequent second group 15 on the outside and, above the second group 15, flows back into the cooling tubes 13 from above at that location. This process is repeated until the last group 17. All the baffles 19-22 are configured in an identical way. They can be surrounded by elastomeric seals in order to effect sealing relative to the surrounding further housing and to avoid bypass flows of the cooling water.

FIG. 5 shows a perspective illustration of the heat exchanger 10 partially in section. The first group 14 is illustrated without the upper tube sheet 23 shown in FIG. 4, leaving the view of the individual cooling tubes 13 and the fins 1 free. From the direction of view in FIG. 6 of said first group 14, it can be seen that the fins 1 are arranged in an arrangement stacked close together one above the other. Via an inflow funnel 24 which increases in size in the flow direction, the gas flow supplied is guided as uniformly as possible onto the inflow area formed by the fins 1. The gas flow flows through between the adjacent fins 1 and, in the process, flows around the cooling tubes 13. This process is repeated from the first until the last group 14-17. From the illustration in FIG. 5, it can be seen that fins 1 of the subsequent group 15 are arranged at a certain distance from the fins 1 of the first group 14. The individual cooling tubes 13, which are arranged in mutually offset rows, together with the respective fins 1 stacked one above the other, form the respective group 14-17 of the heat exchanger 10. A certain spacing between the groups 14-17 is required since space is needed for the baffles 19-22 for diversion of the cooling water. In the region of the baffles 19-22, on the upper side of the individual groups 14-17, one row of cooling tubes 13 is as it were missing, and therefore the groups 14-17 are arranged at a distance from one another.

Figure 7:
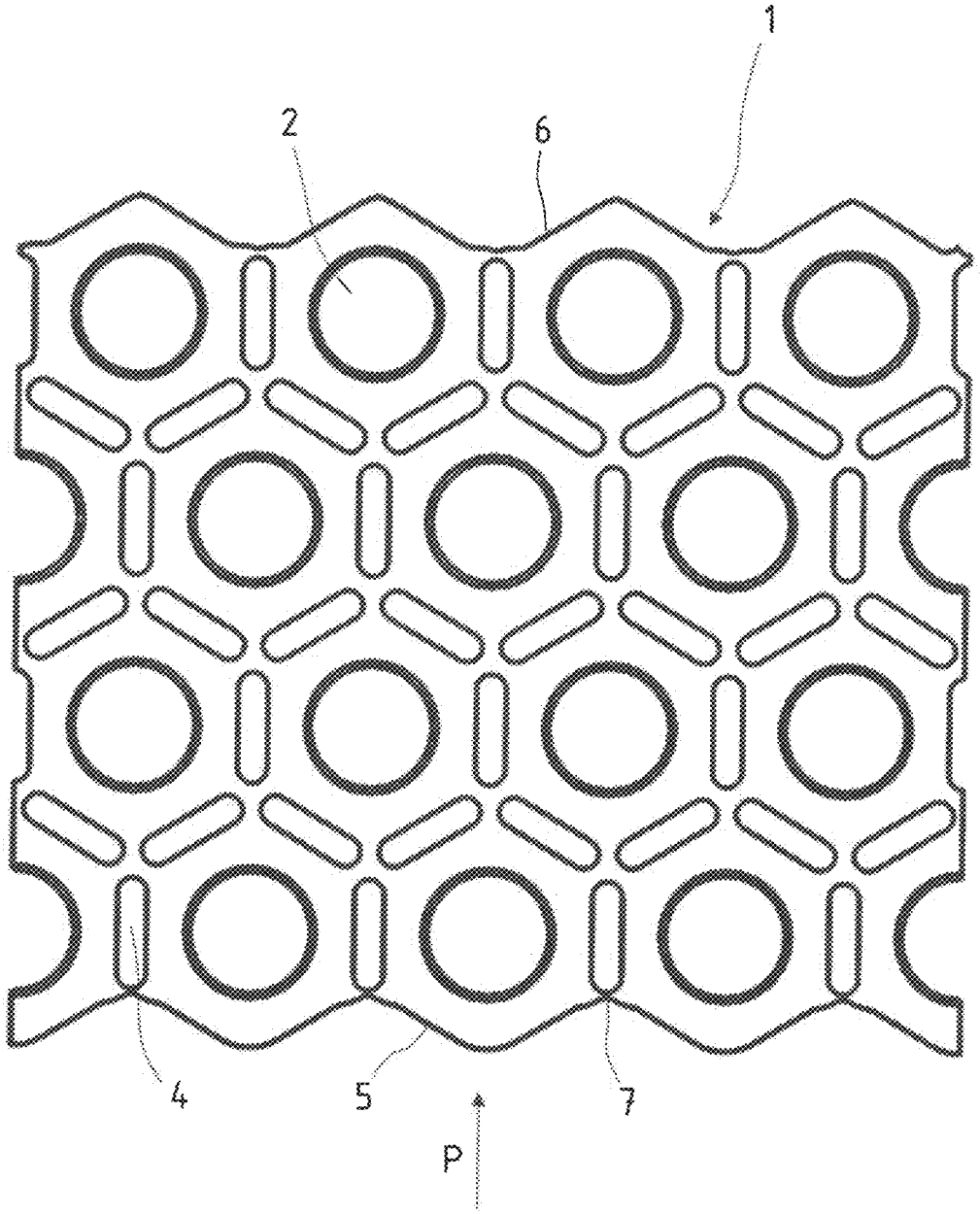
FIG. 7 shows another embodiment of a fin of a heat exchanger in plan view.
Figure 8:
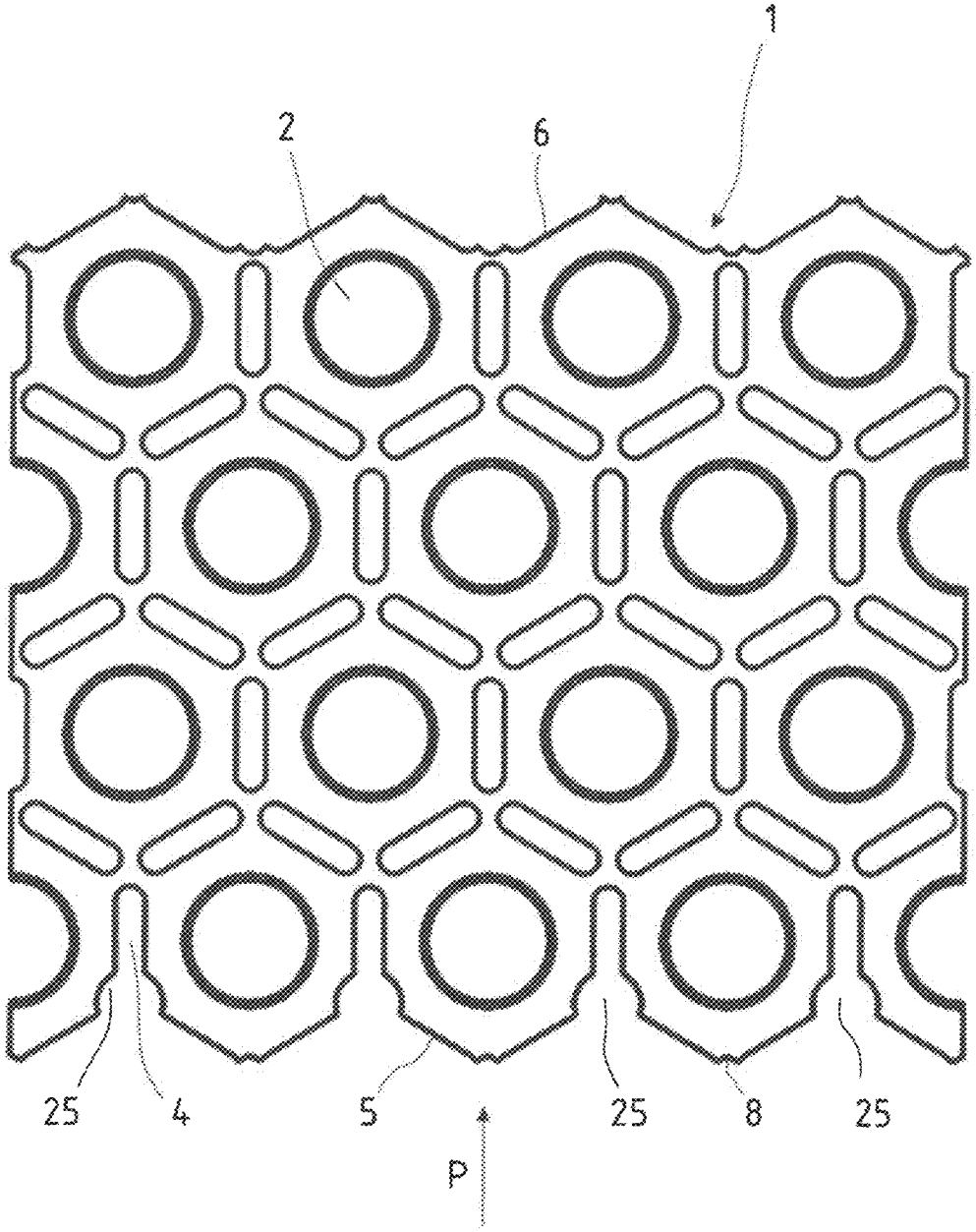
FIG. 8 shows another embodiment of a fin of a heat exchanger in plan view.
Figure 9:
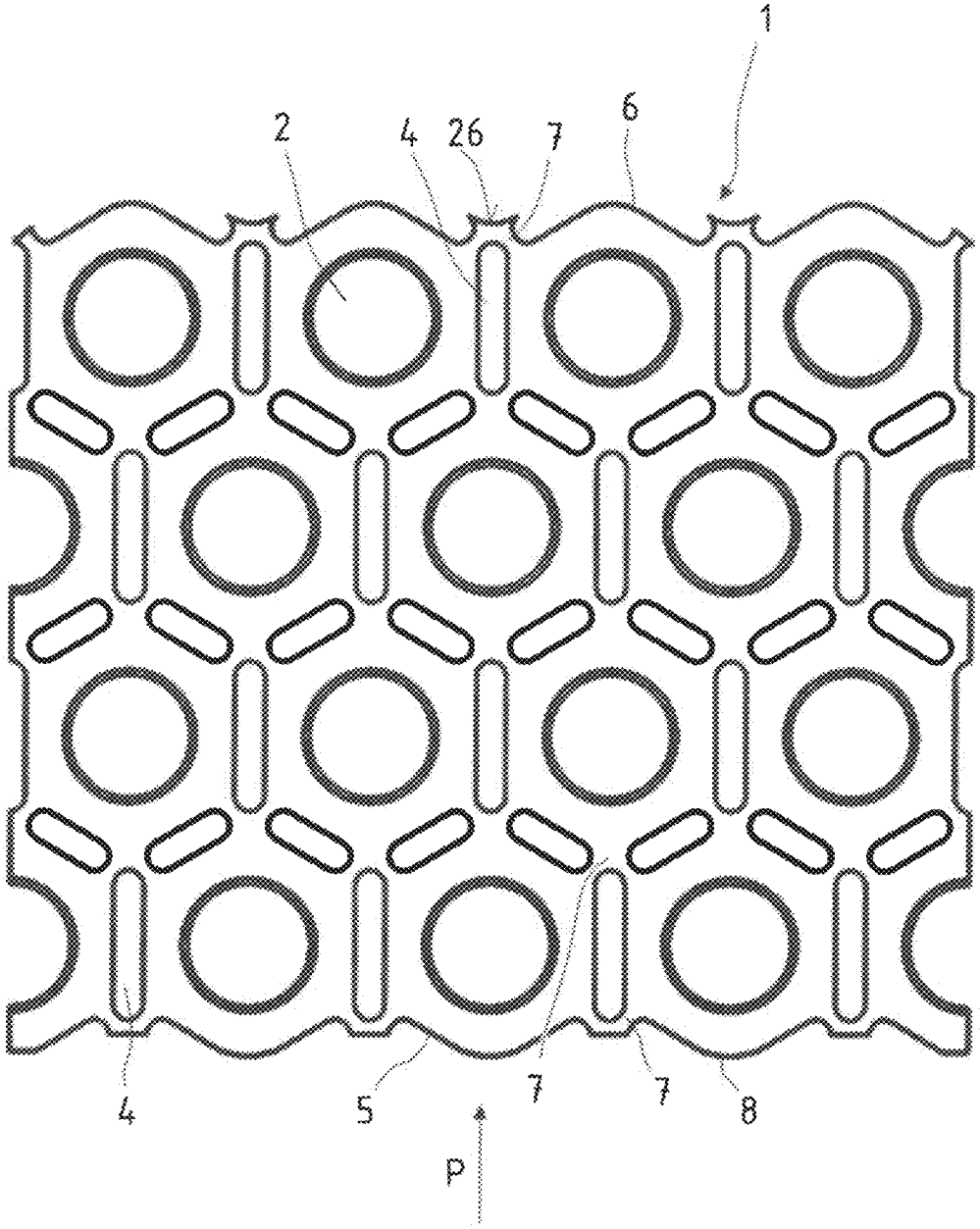
FIG. 9 shows another embodiment of a fin of a heat exchanger n plan view.

FIGS. 7 to 9 show three further illustrative embodiments of fins for said heat exchangers. For these illustrative embodiments, the same reference signs are used for the components of substantially identical construction as for the illustrative embodiment in FIGS. 1 to 3.

The illustrative embodiment in FIG. 7 differs from that in FIG. 1 in width and length. Whereas, in the case of the illustrative embodiment in FIG. 1 a total of six tube rows is arranged in series, there are only four and also only a maximum of four cooling tubes across the width in the illustrative embodiment in FIG. 7. The arrangement and shape of the slits 4 and of the deformation points and openings 2 are identical, however.

Whereas the illustrative embodiment in FIG. 1 shows additional recesses at the deformation points in the edge region on the edge side 5 facing the flow and on the opposite edge side 6, these are not present in the illustrative embodiment in FIG. 7. The edge sides 5 and 6 are as it were rounded. The recesses, which lead to pointed projections in the example in FIG. 1, have been smoothed, with the result that the profile of the edge sides 5, 6 no longer has any sharp jumps or bends in the profile.

The illustrative embodiment in FIG. 8 represents an alternative to this. There, the illustrated fin 1 is provided with additional recesses 25 in the region of its edge side 5 facing the flow. They are arranged where those slits 4 which extend in the flow direction according to the arrow P and thus parallel to the flow direction or perpendicularly to the edge side 5 end. The sawtooth profile of the edge side 5 is interrupted by the additional recesses 25 in the region of the slits 4. The slits 4 open via the recesses 25 into the edge side 5 with the sawtooth profile. The recesses 25 are produced by stamping out the end regions of the slits 4 facing the edge side 5. As a result, the deformation point denoted by 7 in FIG. 1 is omitted and is replaced by a circular recess 25. The diameter of the recess 25 is larger than the width B1 of the slit 4. The diameter is approximately twice as large as the width B1. Concave enlargements of the inlet region of the slit 4 are thereby obtained at the transition from the edge side 5 facing the flow to the slit 4. These enlarged recesses 25 have the effect that the thermally induced stresses in the inflow region of the fin 1 are significantly further reduced, particularly because it is here that the highest temperatures prevail and therefore that material fatigue can occur earlier than on the opposite edge side 5 facing away from the flow.

The illustrative embodiment in FIG. 9 differs from that in FIGS. 1, 7 and 8 in having slits 4 of different lengths. Those slits 5 which point in the flow direction and thus extend parallel to the flow (arrow P) are longer than the other slits 4 lying opposite one another in pairs. This is still a hexagonal arrangement of slits 4. However, said hexagons are no longer uniform but are stretched in the flow direction P. Attention is drawn to the fact that the spacing of the rows R1, R2, R3 (see FIG. 1) has not changed. Only the proportions of the slits 4 have been changed. Whereas the slits 4 extending in the flow direction are somewhat longer than in the illustrative embodiment in FIGS. 1, 7 and 8, the slits 4 extending diagonally to the flow direction P are somewhat shorter. The angular positions of the individual slits 4 relative to one another have not changed. They are still arranged in a star shape with an angle of 120° relative to one another.

Another difference is that the deformation regions 7 are no longer symmetrical. The longer slit 4 of the three adjoining slits 4 extends as it were somewhat deeper into the deformation point 7. The central point of the deformation point 7 is thereby displaced somewhat out of the central position toward one of the adjacent openings 2. In this case, it is those openings 2 which are arranged in series in the flow direction P. By varying the length of the mutually opposite slits 4 arranged in pairs, it is possible to position the central point of the deformation point 7 in a manner appropriate to requirements. It can also be seen that the width of the slits 4 is greater than a minimum width of the respective deformation point 7.

The edge side 5 facing the flow is partially rounded. Where the slits 4 extending parallel to the flow direction P are arranged, the deformation point 7 that is usually present there is split transversely to the inflow direction. At that location, there is a region of the edge side 5 which is perpendicular to the inflow direction P. The slits 4 adjacent to the edge side 5 are not open to the edge side 5, as in the illustrative embodiment in FIG. 8, but are closed. As an option, it is possible to provide additional recesses, as shown in FIG. 7.

On the opposite edge side 6, which faces away from the flow direction P, there are rounded regions in the region of the openings 2, as also shown in FIG. 7. The slits 4 adjacent to the edge side 6 end in a deformation point 7 which is simultaneously part of the edge side 6. As a difference from the side 5 facing the flow, however, the deformation point 7 is not cut off transversely to the flow direction P but has a concave hollow 26. As a result, the deformation point 7 is of somewhat thicker construction in this region than on the edge side 5 facing the flow, this being noticeable at the horns on the corners of the concave hollow 26. At this location, there is more material than on the edge side 5 facing the flow. In the region of the deformation points 7 at that location, the edge side 5 facing the flow is therefore less stiff in bending than the deformation points 7 on the opposite edge side 6 facing away from the flow. This concept of the different bending stiffnesses of the fin 1 in the relationship between the edge side 5 facing the flow and the edge side 6 facing away from the flow has also been followed in the illustrative embodiment in FIG. 8. In principle, the fin 1 should exhibit more flexible behavior on the inflow side than on the outflow side in order to take account of a temperature gradient in the flow direction within the fin 1.

REFERENCE SIGNS

1—fin, lamella
2—opening
3—collar
4—slit in 1
5—edge side
6—edge side
7—deformation point
8—recess
9—incircle of 7
10—heat exchanger
11—gas inlet
12—gas outlet
13—cooling tube
14—group of 10
15—group of 10
16—group of 10
17—group of 10
18—housing of 10
19—baffle of 10
20—baffle of 10
21—baffle of 10
22—baffle of 10
23—tube sheet
24—inflow funnel
25—recesses
26—hollow
B1—width of 4
B2—width of 7 at 8
B3—minimum width of 7
D1—diameter of 2
D2—distance
D3—diameter of 8
D4—diameter at 4
L1—length of 4
M—central point of 4
MLA—central longitudinal axis of 4
P—flow direction
R1—tube row
R2—tube row
R3—tube row
W—angle

The invention claimed is:

1. A heat exchanger for cooling a gas, said heat exchanger comprising:

a gas inlet;

a gas outlet;

a plurality of cooling tubes arranged between the gas inlet and the gas outlet, wherein the cooling tubes of two successive tube rows are arranged offset transversely to a flow direction of the gas; and a fin having openings for receiving a corresponding number of the cooling tubes and slits having a longitudinal side and opposing ends, with the longitudinal side of the slits being aligned with an edge profile of a honeycomb-shaped hexagon surrounding a corresponding one of the openings at a distance, wherein adjacent ones of the openings are separated by a corresponding slit located between the adjacent openings, with at least one end of each slit terminating at a deformation point of the fin.

2. The heat exchanger of claim 1, wherein the slits have a straight configuration.

3. The heat exchanger of claim 1, wherein the slits have a width which is greater than a minimum width of the deformation point.

4. The heat exchanger of claim 1, wherein the cooling tubes are arranged in groups arranged between the gas inlet and the gas outlet, wherein one of the groups of cooling tubes in adjacent relation to the gas inlet is penetrated by a plurality of said fin.

5. The heat exchanger of claim 4, wherein a plurality of the groups of cooling tubes is penetrated by a plurality of said fin.

6. The heat exchanger of claim 1, wherein the cooling tubes are arranged in groups, with one of the groups of cooling tubes comprising at least two tube rows which are in series in the flow direction of the gas.

7. The heat exchanger of claim 1, wherein the fin has edge sides lying in the flow direction of the gas, with at least one of the edge sides being shaped with a sawtooth profile corresponding to a pattern of the slits.

8. The heat exchanger of claim 7, wherein the edge sides include recesses for formation of the deformation point with those of the slits which are adjacent to the at least one of the edge sides.

9. The heat exchanger of claim 1, wherein the fin has a thickness of less than 0.16 mm.

10. The heat exchanger of claim 1, wherein the fin has a flat configuration.

11. The heat exchanger of claim 1, wherein the fin is formed with embossed features between the openings, said slits arranged outside the embossed features.

12. The heat exchanger of claim 1, wherein mutually opposite pairs of the slits of a hexagon are of equal length, with one pair of mutually opposite slits having a length which is different than a length of the two other pairs of mutually opposite slits of the hexagon.

13. The heat exchanger of claim 12, wherein the slits extending perpendicularly to an edge side of the fin in facing relation to a flow of gas have a length which is longer than a length of the two other pairs of mutually opposite slits of the hexagon.

14. The heat exchanger of claim 1, wherein the slits are all of equal length.

15. The heat exchanger of claim 1, wherein the slits adjoining an edge side of the fin in facing relation to a flow of gas are open toward the edge side.

16. The heat exchanger of claim 1, wherein the deformation point is a center of a star-shaped arrangement of three slits located between three adjacent openings.

* * * * *